US007689152B2

(12) United States Patent
Nishida et al.

(10) Patent No.: US 7,689,152 B2
(45) Date of Patent: Mar. 30, 2010

(54) IMAGE FORMING APPARATUS WITH FIRST AND SECOND TRANSFER SECTIONS

(75) Inventors: Satoshi Nishida, Saitama (JP); Mineyuki Sako, Toyokawa (JP); Shigetaka Kurosu, Hino (JP); Kazuteru Ishizuka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 225 days.

(21) Appl. No.: 11/646,145

(22) Filed: Dec. 27, 2006

(65) Prior Publication Data

US 2007/0172267 A1 Jul. 26, 2007

(30) Foreign Application Priority Data

Jan. 23, 2006 (JP) ..... 2006-013512
Aug. 22, 2006 (JP) ..... 2006-225098

(51) Int. Cl.
*G03G 15/01* (2006.01)

(52) U.S. Cl. ..... 399/302

(58) Field of Classification Search ..... 399/302, 399/310, 314

See application file for complete search history.

(56) References Cited

U.S. PATENT DOCUMENTS 5,729,810 A * 3/1998 Bergen et al. ..... 399/313
6,014,537 A * 1/2000 Van Aken et al. ..... 399/271
6,430,379 B1 * 8/2002 Takahashi et al. ..... 399/44
2004/0038141 A1 * 2/2004 Yoshida et al. ..... 430/108.3
2004/0131373 A1 * 7/2004 Saito et al. ..... 399/66
2005/0276620 A1 * 12/2005 Omata ..... 399/49

FOREIGN PATENT DOCUMENTS

JP 3-248181 11/1991
JP 2000181252 A * 6/2000
JP 2006323296 A * 11/2006
WO WO02/069056 A1 * 9/2002

* cited by examiner

*Primary Examiner*—David M Gray
*Assistant Examiner*—Andrew V Do
(74) *Attorney, Agent, or Firm*—Cantor Colburn LLP

(57) ABSTRACT

An image forming apparatus may include a first transfer section for transferring a toner image, formed on an image carrier by utilizing a charging section, an exposing section and a developing section, onto a belt shaped intermediate transfer member; and a second transfer section for transferring the toner image on the intermediate transfer member onto a recording material by applying an electric field between a second transfer roller being provided outside the intermediate transfer member and a backup roller being provided inside the intermediate transfer member, the second transfer roller and the backup roller sandwiching the intermediate recording member and the recording material. The second transfer roller may be grounded and a bias voltage may be applied to the backup roller, and a second charging section for charging a surface of the second transfer roller with a predetermined polarity may be included.

3 Claims, 4 Drawing Sheets

IMAGE FORMING APPARATUS WITH FIRST AND SECOND TRANSFER SECTIONS

CROSS REFERENCE TO RELATED APPLICATION

This application is based on Japanese Patent Application No. 2006-013512 and No. 2006-225098 respectively filed on Jan. 23, 2006 and Aug. 22, 2006 with Japanese Patent Office, the entire content of which is hereby incorporated by reference.

BACKGROUND OF THE INVENTION

1. Field of the Invention

The present invention relates to an image forming apparatus in which a toner image formed on an image carrier is transferred onto an intermediate transfer member (primary transfer) once and then transferred onto a transfer material (second transfer) by using an electro-photographic method.

2. Description of Related Art

An image forming apparatus having a configuration described below is well known.

Namely, a developing section including a photosensitive material drum (an image carrier), a charging section, an exposing section and a developing section for magnetically attracting developer composed of carrier and toner onto a rotating sleeve and transferring to a developing area is provided for each color of yellow, magenta, cyan and black.

Then, when forming an image, after forming a toner (powder) image according to the image data for each color onto the photosensitive material drum, these toner images are sequentially transferred (primary transfer) onto a belt shaped and rotating intermediate transfer member, which is synchronized with the photosensitive material drum to form a superimposed color toner image onto the intermediate transfer member.

Next, the second transfer section structured by a backup roller capable of rotating, provided inside the intermediate transfer member and a second transfer roller provided outside of the intermediate transfer member transfers (second transfer) the color toner image onto the transfer material such as paper sheets.

In such an image forming apparatus, for example, the toner image formed on the photosensitive material drum can be obtained by reversal development. On this development stage, there is a case that toner happens to adhere on the outside area on which the toner image is formed (an area of the front and rear side of the image area viewing the photosensitive material drum in the rotational direction).

This excessive toner moves to the intermediate transfer member, and further moves and adheres on the second transfer section such as the surface of the second transfer roller. This excessive toner dirties the rear surface of the transfer material, which is conveyed to the second transfer area, following to the preceding transfer material. As a result, this problem causes to damage of the quality as products.

Particularly, in the color image forming apparatus as described above, comparing with, for example, a monochrome (single color) image forming apparatus, the quantity of toner for adhering the outside of the image area of the intermediate transfer member becomes large. Thus, how to remove the toner from the second transfer roller is extremely big issue.

Japanese Patent Application Open to Public Inspection No. H03-248181 disclosed a following method in order to suppress the problems described above.

In aforementioned Japanese Patent Application, an image forming apparatus having no intermediate transfer member was disclosed as an example. However, toner adheres on the surface of the transfer rollers corresponding to the second transfer roller described above and the problems caused by the toner is the same as described above. The method for solving the problems can be basically applied to the image forming apparatus having an intermediate transfer member.

According to the method disclosed in aforementioned Japanese Patent Application, the method comprises the steps of passing a transfer material into a transfer section being a nip section structured by an image carrier and a transfer section touching to the image carrier, applying bias voltage having a polarity, which is reverse to the bias voltage at a time when the transfer material exists in the transfer section, when transfer material does not exist in the transfer section at no transfer operation period, and keeping a polarity of residual toner on a surface of the transfer section entering into the transfer section reverse to the polarity of the transfer bias voltage at least while the transfer material is passing through the transfer section.

Based on this arrangement, in the image forming apparatus utilizing a contact type transfer section such as transfer rollers, suppressed are the contamination in the apparatus and dirt on the rear side of the transfer material caused by the toner adhering to the transfer section.

With regard to the toner adhesion and removal to and from the transfer section, further concrete behavior of the toner will be described below.

Namely, when taking the method for visualizing a latent image on the image carrier charged in minus by using the toner charged in plus, the transfer process is conducted by applying a minus transfer bias voltage to the transfer roller when conducting the transfer operation and a plus bias voltage is applied to the transfer roller after completing the transfer operation.

Even though a part of toner on the transfer roller can be returned to the image carrier when non-transferring, due to the discharge at the transfer section, other toner is charged in minus and resides on the transfer roller.

With regard to the residual toner, toner charged in minus returns to the image carrier by applying minus bias voltage to the transfer roller again. However, a part of toner is charged in plus and as a result the other toner resides on the transfer roller.

By maintaining this state until the transfer roller makes one rotation, almost all of the toner charged in minus can be returned to the image carrier side.

As described above, the polarity of the charged toner on the transfer roller becomes reverse to the polarity of transfer bias voltage.

The transfer operation to the next transfer material is conducted after becoming to this situation. However, since the toner charged in minus is in a situation where the toner charged in minus has been electro-statically absorbed on the transfer roller, it does not dirty the rear surface of the transfer material.

However, according to the cleaning method of the transfer roller disclosed in aforementioned Japanese Patent Application, namely, the method for changing the bias voltage applied to the transfer roller when conducting the transfer operation and the non-transfer operation, the dirt on the rear surface of the transfer material can be prevented. However, following problems described below occur.

When conducting the transfer operation, the transfer bias voltage (minus voltage) is applied to the transfer roller. However, since the bias voltage, which is reverse to the transfer bias voltage, is applied to the transfer roller when conducting non-transfer operation, the electric charge caused by the bias voltage at the time of non-transfer operation has a role for canceling the bias voltage at the time of transfer operation. As a result, the efficiency of the voltage or current of the transfer bias becomes very bad.

As described above, in Japanese Patent Application Open to Public Inspection No. H3-248181, since switching operation of the bias voltages against the transfer roller is conducted, bias voltages before and after the switching operation affect each other and electric field of transfer operation becomes unstable.

Further, in the Japanese Patent Application Open to Public Inspection No. H3-248181, electric charging by a corotron charging section is conducted against the transfer roller, and switching to the transfer bias voltage is conducted while the electric charging is conducted. However since the polarity of the transfer bias voltage is an opposite polarity of the electric charging by the corotron charging section, the transfer bias voltage becomes further unstable.

An object of the present invention is to solve the problems associated with the prior art in which the transfer roller is cleaned as described above, and to prevent the dirt on the rear surface occurred in the transfer section appropriately.

SUMMARY OF THE INVENTION

The object of the present invention can be attained by a following structure.

An image forming apparatus including a first transfer section for transferring a toner image, formed on an image carrier by utilizing a charging section, an exposing section and a developing section, onto a belt shaped intermediate transfer member; and a second transfer section for transferring the toner image on the intermediate transfer member onto a recording material by applying an electric field between a second transfer roller being provided outside the intermediate transfer member and a backup roller being provided inside the intermediate transfer member, the second transfer roller and the backup roller sandwiching the intermediate recording member and the recording material, wherein the second transfer roller is grounded and a bias voltage is applied to the backup roller, and further provided is a second charging section for charging a surface of the second transfer roller with a predetermined polarity.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Embodiments pertaining to the present invention will be described in detail by using drawings.

Figure 1:
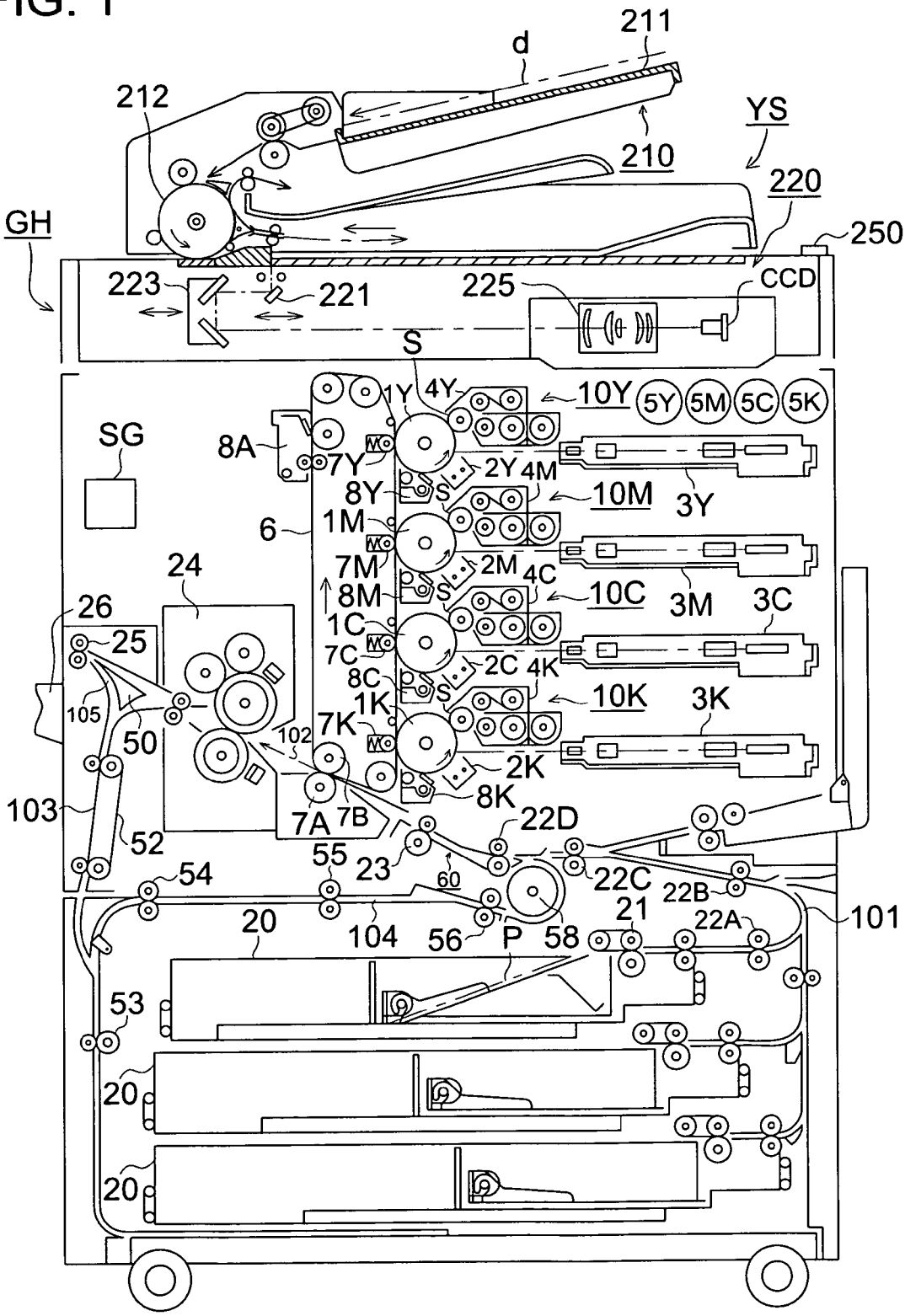
FIG. 1 illustrates a total image forming apparatus having a tandem configuration, which is capable of generating a full color image.

FIG. 1 illustrates a total image forming apparatus having a tandem configuration, which is capable of generating a full color image.

In FIG. 1, an image forming apparatus main body GH comprises a plurality of image forming sections 10Y, 10M, 10C and 10K, an intermediate transfer member 6 having a belt shape, a sheet conveyance section and a fixing section 24.

On the top surface of the main body of the apparatus, an operation section 250 including print buttons, ten keys, mode (single sided recording, double sided recording) setting buttons, and a touch panel type operation display section for conducting a copy density setting, sheet selection and magnification selection is provided.

An image forming section 10Y for forming a yellow (Y) colored image comprises an image carrier 1Y, a charging section 2Y disposed on the circumference of the image carrier, an exposing section 3Y, a developing section 4Y and a cleaning section 8Y.

An image forming section 10M for forming a magenta (M) colored image comprises an image carrier 1M, a charging section 2M disposed on the circumference of the image carrier, an exposing section 3M, a developing section 4M and a cleaning section 8M.

An image forming section 10C for forming a cyan (C) colored image comprises an image carrier 1C, a charging section 2C disposed on the circumference of the image carrier, an exposing section 3C, a developing section 4C and a cleaning section 8C.

An image forming section 10K for forming a black (B) colored image comprises an image carrier 1B, a charging section 2B disposed on the circumference of the image carrier, an exposing section 3B, a developing section 4B and a cleaning section 8B.

The image carrier, the charging section, the exposing section and the developing section for each color described above structures an image forming section. The charging section and the exposing section for each color structure a latent image forming section.

Each exposing section described above comprises a semiconductor laser exposing apparatus having a laser light source, an fθ lens, a collimator lens, and a polygon mirror.

Each developing section described above carries developer including two ingredients, toner and carrier as main ingredients on the surface thereof. The each developing section comprises a developer carrier member S structured by a sleeve which can convey the developer to the developing area and a magnet (not shown) provided at a fixed place in the developer carrier S.

The magnet described above is deployed so that the function for attracting the developer onto the developer carrier member S and the function for automatically removing the developer from the developer carrier member S. However, since the structure is well known, it will be omitted here.

The intermediate transfer member 6 described above is supported by a plurality of rollers (no referring number) so as to freely rotate.

The intermediate transfer member 6 is composed of polyimide resin, which can structure a seamless belt having a volume resistance of approximately $1\times10^{8}$ Ω·cm. However, since this type of belt is basically known and it is not a direct feature of the present invention, detail explanation will be omitted here.

In this embodiment, a toner image formed on the photosensitive material being an image carrier is transferred onto the intermediate transfer member 6, then transferred onto the final transfer material, for example, a paper sheet. Accordingly, the intermediate transfer member may be called an image carrier. However, in order to avoid confusion, a photosensitive material will be called a photosensitive material, and an intermediate transfer member will be called an intermediate transfer member.

The first transfer sections 7Y, 7M, 7C and 7K, structured by conductive rollers are disposed at the positions, which are opposed to each photosensitive material, the positions being located inside the intermediate transfer member 6.

At the position, which opposes to the transfer material, a backup roller 7B, which is provided inside the intermediate transfer member 6 and a second transfer roller 7A contacting with the backup roller 7B are provided so as to sandwich the intermediate transfer member 6 as a second transfer section.

Hereinafter, the second transfer section will be occasionally called a second transfer roller 7A.

The second transfer roller 7A is a roller composed of a metal shaft around which solid rubber is provided and further a surface layer (a coat layer) is provided thereon. The resistance value of the solid rubber is $4\times10^7$ Ω (when 1000 V is applied to the solid rubber).

With regard to the solid rubber, for example, NBR (Nitrile Butadiene Rubber) is suitable. With regard to the surface layer, Urethane resin or a thin film (for example, 5 μm) formed by fluorine resin is practical and suitable.

However, they are not limited to these examples described above.

In this embodiment, the second transfer roller 7A is grounded. The second charging section to be used for charging the surface of the second transfer roller (with electrostatic charges) when non-transferring, namely when cleansing, is disposed near the second transfer roller 7A.

The backup roller 7B comprises a metal shaft and a surface layer structured by solid rubber in the same way as the second transfer roller. When transferring (conducting a transfer process), bias voltage having a predetermined polarity (here, minus polarity) is applied to the backup roller 7B. When non-transferring, namely, when cleaning, plus bias voltage having a polarity reverse to the transfer bias is applied to the backup roller 7B. This will be described in detail later.

The first transfer sections (7Y, 7M, 7C and 7K) are respectively biased by springs so that the first transfer sections 6 are pressed to the intermediate transfer member 6.

A reference number 8A denotes a cleaning section including a blade for keeping the surface of the intermediate transfer member 6 clean.

The fixing section 24 comprises a roller type fixing apparatus which includes a first heating roller including a heat source and a second heating roller provided so that the second heating roller rotates while contacting with the first heating roller with pressure, or a second roller.

In FIG. 1, 5Y, 5M, 5C and 5K denote toner supply sections for supplying toner corresponding to the respective colors of the toner to respective developing sections.

An image reading apparatus YS provided on the upper portion of the main body of the image forming apparatus GH includes an automatic document feeding apparatus 210 and a document image scanning & exposing apparatus 220.

"d" denotes documents, which are placed on a document placing table 211 provided on the automatic document feeding apparatus 210 are separated sheet by sheet by a separating section, which does not have a reference number. Then each document is transferred to a reading position by the conveyance section structured by rollers and a drum capable of rotating 212 and are read out by the document image scanning & exposing apparatus 220.

The document image scanning & exposing apparatus 220 includes a first block 221 including an irradiating lamp and a first mirror, which are integrated into one unit, a second block including a second mirror and a third mirror, which are integrated into one unit, an image forming lens 225 and a line image sensor CCD.

In other words, an image on the document "d", which is in the conveyance state, is irradiated by the irradiating lamp at the reading position. Then the light beams including the image information come to the image forming lens 225 through the three types of mirror described above. Then, the light beams are sequentially converged to form an image onto the line image sensor CCD and read out.

The image information (analog signals) read by the line image sensor CCD is memorized by the memory in a controller SG after the image information is appropriately processed by the image processing section for conducting analog signal processing, A/D conversion, shading correction and image compression process.

The image data memorized in the memory is read out according to the image forming process and transmitted to an exposing section (3Y, 3M, 3C and 3K) being an image writing section.

The exposing section is to irradiate the laser beams modulated according to the image data onto the surface of photosensitive material (1Y, 1M, 1C and 1K) to form an electrostatic latent image corresponding each color.

The automatic document feeding apparatus 210 includes automatic dual surface document feeding section. Accordingly, a large number of document d fed from the top of the document placing table 211 are continually read at once and stored into the memory. When copying a plenty of contents of document d by using a copy function, or transmitting a lot of document d by using a facsimile function, this automatic document feeding apparatus 210 can be conveniently used.

In FIG. 1, SG denotes a controller (hereinafter it may be called a control section) including ROM and RAM and a computer for effectively executing all process control of the imager forming apparatus for conducting a sequence control for image formation, such as a conveyance control of transfer material (hereinafter it will be called a paper sheets or a transfer sheet), a temperature control of the fixing section, an operation control of the second charging section and a switching control of bias voltage to the backup roller while obtaining the output information from various sensors (actuators).

Figure 2:
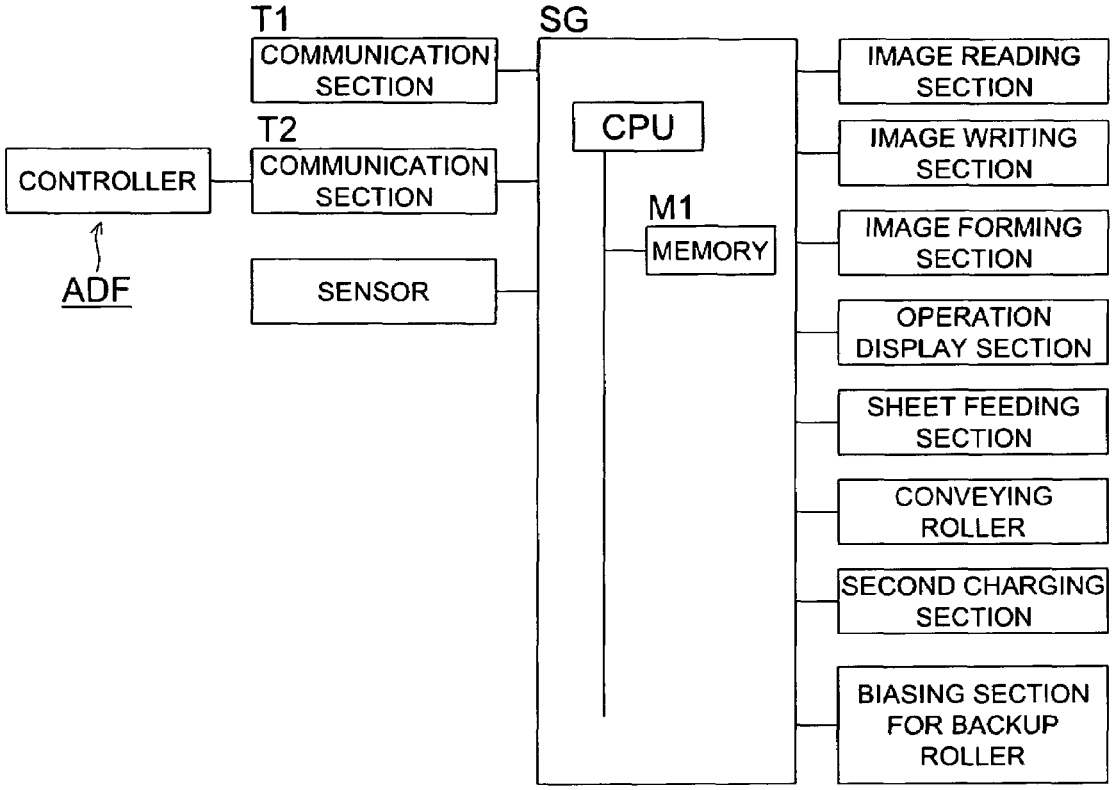
FIG. 2 illustrates a block diagram schematically showing a controller.

FIG. 2 illustrates a block diagram schematically showing controls described above.

The controller SG is a computer system having a CPU, a memory M1, an operation unit, an I/O port and communication interface, even though which are not shown in FIG. 2. The controller SG also includes circuits for controlling various sections.

The controls of various sections are conducted by executing programs stored in the memory 1.

Still, the control of the automatic document feeding apparatus ADF has the same system configuration, which is a CPU centered system, as that of the controller SG even though the size of the system is small comparing with the controller SG.

The controller SG and the control section of the ADF are connected via a communication section T2 in this example.

The controller SG connected to LAN or public communication network is arranged to exchange data with other information equipment through the LAN and the public communication network.

Referring back to FIG. 1, feeding cassettes 20 for storing sheets P having a sheet shape, which are provided with three steps in the vertical direction in the lower portion of the main body of the image forming apparatus GH.

Reference number 21 denotes a sheet feeding sections and reference number 22A denotes conveyance rollers provided downstream of the sheet feeding sections 21. These sections are provided for respective sheet feeding cassettes. In FIG. 1, reference numbers are given to the sections pertaining to the cassette placed on the most upper section as a representative.

22B, 22C and 22D denote conveyance rollers (a conveyance roller group) provided in the common conveyance section of the first conveyance path 101, which convey the sheet P fed from the each sheet cassette to the registration roller 23.

The registration roller 23 is located in the place, which is most closest place to the transfer place where the second transfer section 7A is located comparing with the conveyance roller group (this means that the registration roller 23 is located in a place, which is the most closest to the transfer place comparing with other conveyance rollers when viewing in the sheet conveyance direction). The controller SG drives and controls the registration roller 23.

The direct driving source is a stepping motor, which is provided only for driving the registration roller, the stepping motor being omitted from the Figure.

The point is that, as long as the motor is capable of precisely controlling the speed, the motor is not limited to this example.

The registration roller 23 is controlled so as to come to a stop-rotating state when the sheet P touches to the registration roller 23, which has been conveyed via the sheet feeding section and the conveyance rollers 22B according to an image forming process.

Under this condition, when the sheet P touches to the registration roller 23 and after that a little conveyance force is added to the sheet P, the front end section of the sheet P is inserted into the nip section of the registration roller 23. As a result the skew of the sheet P is corrected (regulated).

The registration roller 23 is controlled so that the sheet P always reaches to the transfer position with good timing against the toner image (area) formed on the intermediate transfer member 6.

Illustrated (in FIG. 1) is the second conveyance path (hereinafter it will be called the second conveyance path 102) from the registration roller 23 to an ejection roller 25, the third conveyance path (hereinafter it will be called the third conveyance path 103) including a belt conveyance section 52 passing the right side of a conveyance switching section 50 and communicating to a conveyance roller 53, the fourth conveyance path (hereinafter it will be called the fourth conveyance path 104), which turns the sheet P conveyed to the third conveyance path 103 and conveys the sheet P to the conveyance roller 22D via conveyance rollers 54, 55, 56 and a drum 58 and a conveyance path 105 (hereinafter it will be called the fifth conveyance path 105), which turns the sheet P conveyed to the third path 103 and conveys the sheet P to the ejection roller 25 via the left side of the conveyance switching section 50.

Total operation pertaining to the image formation process will be simply described while adding a little supplementary explanation.

For the sake of convenience, with regard to the exposing section, the photosensitive material, or a plurality of sections, when it is not necessary to distinguish the color, these are simply called an exposing section 3 and photosensitive material 1, etc.

As described above, when having conducted the reading out operation of the document by the line image sensor CCD, and exposing operation according to the image data generated by the image processing section, an electro static latent image is formed on the photosensitive material 1 on which minus electric charges have been applied.

The exposure is conducted per each color with an appropriate timing. A generated latent image per each color is converted into a toner image by adhering toner, which has been intentionally charged with minus polarity by friction charging operation under the action of the developing section 4 and developing bias voltage.

The development process is conducted, for example, by a jumping development.

At this time, there is a case that unwanted toner adheres the front portion or the rear portion outside of the area, onto which a toner image is supposed to be formed, viewing from the rotational direction of the photosensitive member.

This unwanted toner is sequentially transferred onto the intermediate transfer member with the toner image under the operation of the first transfer section 7.

The surface of each photosensitive member 1 passing through the transfer area is cleaned by the cleaning section 8 and to be prepared for the next image formation.

On the other hand, the toner image of each color is superimposed on the intermediate transfer member 6 to form a full color toner image and the toner image area is moved toward the transfer position by the continuous rotation of the intermediate transfer member 6.

At this moment of time, the sheet P, which is supplied according to the image forming process, has already touched with the registration rollers 23 and has been sandwiched by them. Then, the sheet P is driven in synchronizing with a timing of the rotation of the registration roller and conveyed toward the transfer position (where the second transfer section 7A is located). As a result, the toner image area and the sheet P moves in the second transfer section under the superimposing state.

Then, at the transfer position, the toner image of the intermediate transfer member 6 is transferred onto the sheet P by receiving the action of the second transfer section 7A to which electric current of appropriate current value is applied.

In concrete, the toner image is transferred on the sheet P by the action of the electric field formed between the second transfer roller 7A, which is grounded and the backup roller 7B, to which a minus bias voltage is applied.

The fixing section 24 provided on the second conveyance path 102 heats and presses the toner image onto the sheet P. Then the sheet P is ejected to a tray 26 provided outside the apparatus via the eject roller 25.

At this moment of time, the conveyance switching section 50 is kept at the position as illustrated in a solid line in FIG. 1 to keep the second conveyance path 102 open.

After the image formed on the intermediate transfer member 6 has transferred onto the sheet p by the second transfer section 7A, the cleaning section 8A cleans the intermediate transfer member 6 to allow the intermediate transfer member 6 to be used as an new intermediate transfer member.

An example of single surface recording mode for forming an image on the first surface (surface) of the sheet P has been described above. In the case of dual surface recording mode for forming images on both surfaces of the sheet P, the sheet conveyance path will be as following.

After the fixing process has been applied, the sheet P onto one side of which an image has been formed, is guided to the third conveyance path 103 by switching the conveyance path by the conveyance path switching section 50 and stops in the state that the rear end of the sheet P is sandwiched by the conveyance rollers 53.

Then, the conveyance rollers 53, which are driven into the reverse rotation direction against the previous rotation direction transfers the sheet P upward. Then the sheet P is transferred into the fourth conveyance path 104, which has been kept open by the conveyance switch of a conveyance path switching member (no reference number is placed here) and is turned up side down.

Further, the sheet P is continuously conveyed by the conveyance roller groups 55 and 56, and a drum 58 until the sheet P touches to the registration rollers which are under the rotation-drive-stop condition.

Then, the sheet P is fed toward the transfer position by the registration rollers 23, the rotation and driving of which are controlled so that the toner image held on the intermediate transfer member 6 is superimposed on the sheet P. The toner image is formed on the second surface (a rear surface) based on the action of the second transfer section 7A.

Then after the fixing process is conducted, the sheet P will be ejected via the eject roller 25.

At this moment of time, the conveyance path switching section 50 keeps the second conveyance path 102 open.

Still, when the mode for turning the sheet P, onto the first or both surfaces of which the image is formed, up side down and ejecting is selected to adjust the page, the conveyance route of the sheet P will be as following.

Namely, the sheet P, to which the fixing process of the last image is conducted, is guided into the third conveyance path 103 and is paused when viewing from the conveyance direction of the sheet P while the trailing end of the sheet P is under the situation where the sheet P is sandwiched by the belt conveyance section 52.

By the way, while the outside area positioned in front and rear sides of the toner image area on the intermediate transfer member 6 pass through the second transfer section, the second transfer roller 7A is grounded and minus bias voltage is applied to the backup roller 7B. Then the unwanted toner described above electro-statically adheres onto the second transfer roller 7A.

Figure 3:
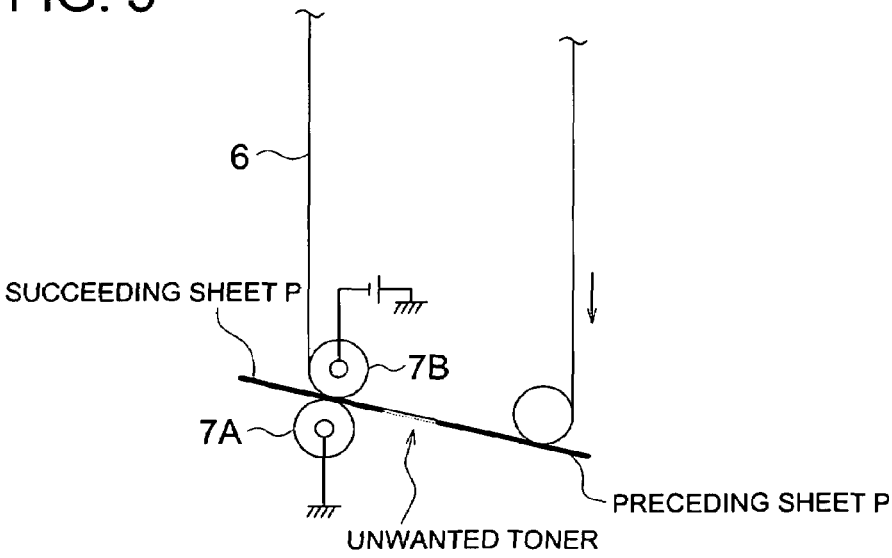
FIG. 3 illustrates a drawing for explaining unwanted toner.

Then, when conveyed is the rear surface of the paper sheet P which is under transfer or the leading edge of the sheet P which is under the situation where the trailing edge of the preceding sheet P is close to the front edge, such as continuous printing (referring to FIG. 3 for describing the unwanted toner inconvenience), the succeeding sheet P becomes dirty with the unwanted toner.

Figure 4:
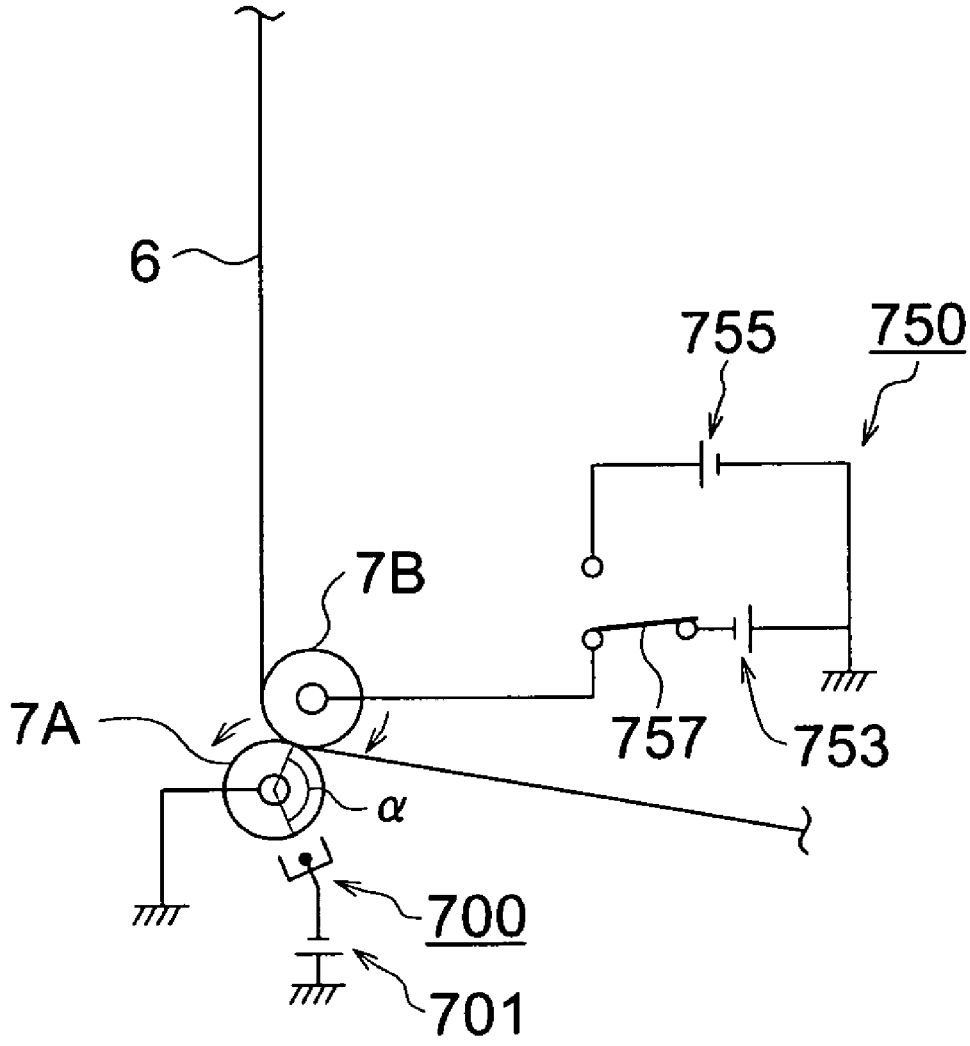
FIG. 4 illustrates a drawing for magnifying a main point for showing the schematic configuration of the second transfer section illustrated in FIG. 1.
Figure 5:
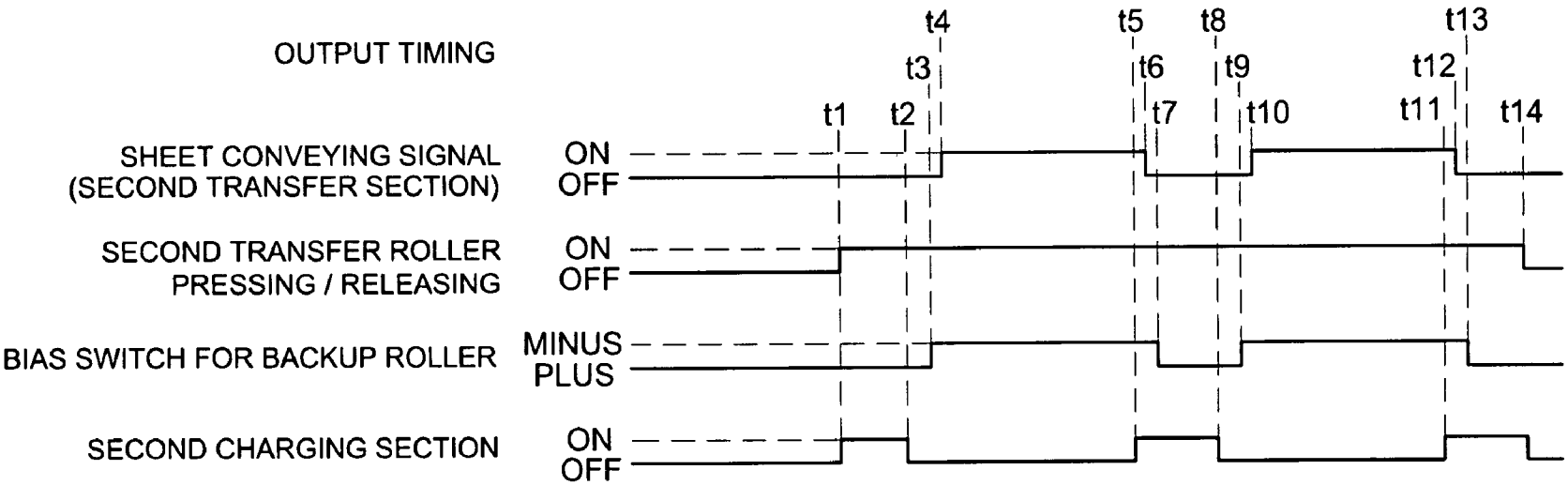
FIG. 5 illustrates a timing chart for showing a sheet conveying signal of a sheet in a transfer section, pressing/releasing of the second transfer roller against the backup roller, bias voltage switch for the backup roller and the control for the second charging section.

In order to prevent the rear surface from becoming dirty, in an embodiment of the present invention, the bias voltage switching to the backup roller 7B illustrated in FIG. 4 will be conducted at the timing illustrated in FIG. 5 to conduct cleaning of the second transfer roller 7A.

FIG. 4 illustrates a drawing for magnifying the main point for showing the schematic configuration of the second transfer section illustrated in FIG. 1. FIG. 5 illustrates a timing chart for showing the sheet conveying signal of the sheet in the transfer section, pressing/releasing of the second transfer roller against the backup roller, bias voltage switch for the backup roller and the control for the second charging section.

Still, this chart illustrates an example when the sheet P of A4 size is conveyed with long edge feeding (this means that the short edges of the sheet P are placed parallel to the conveyance direction) and two sheets are continuously conveyed.

As illustrated in FIG. 4, either a voltage source 755 having plus bias voltage or a minus bias voltage source 753 having minus bias voltage is selected by a switch 757 and applied to the backup roller 7B.

When non-transferring, the voltage source 755 having plus bias voltage is applied to the backup roller 7B and, at the same time, the second charging section 700 charges the surface of the second transfer roller 7A with minus electro-static charges so that unwanted toner on the second transfer roller 7A adhere to the intermediate transfer member 6 to clean the second transfer roller 7A.

The phrase "when non-transferring" denotes the time durations between times t1 and t4, and times t6 and t10 as illustrated in FIG. 5. These time durations correspond to the time duration at the time just before the sheet P passes through the nip section formed by the second transfer roller 7A and the intermediate transfer member 6 and the time duration between the trailing edge of the preceding sheet P and the leading edge of the succeeding sheet P when forming an image onto the sheets P which are continuously conveyed.

In FIG. 4, the second charging section 700 (Corona discharging electrode) having a discharging wire stretched in an insulation state in a U-shaped shield is disposed near the second transfer roller 7A, which is grounded via the metal shaft (no reference number). When non-transferring, minus voltage is applied to the discharging wire from a voltage source 701 based on the control of the controller SG, the second charging section 700 charges the surface of the second transfer roller with electric charges (Corona charging).

In other words, the second charging section 700 is to prevent unwanted toner from adhering to the second transfer roller as described above, which functions as a cleaning section against the second transfer roller 7A.

On the other hand, with regard to the backup roller 7B, provided is the voltage source circuit 750, which is arranged to supply predetermined bias voltage to the backup roller 7B via the metal shaft by switching the bias Voltage.

Concretely, when transferring, which is to transfer the toner image formed onto the intermediate transfer member 6 onto the sheet P, predetermined minus voltage (bias voltage) is applied via the voltage source 753 to the backup roller 7B, and when non-transferring (when cleaning), predetermined plus voltage (bias voltage) is applied to the backup roller 7B via the voltage source 755.

Reference number 757 denotes a voltage source switching section (a switch) capable of supplying bias voltage to the backup roller 7B based on the control of the controller SG as described above.

In this embodiment of the present invention, the voltage applied to the discharging wire is 6000 V, the bias voltage to the backup roller is minus 3 KV when transferring, and plus 2 KV when non-transferring. However, these values may be appropriately changed.

The angle $\alpha$ shown in the second transfer roller 7A illustrated in FIG. 4 is to explain that while conducting transfer operation onto the sheet P, which is not show, the second charging section 700 is turned on and when the first charged position on the circumference surface of the second transfer roller reaches to the transfer area, the trailing edge of the sheet P is arranged to pass the transfer area substantially the same timing.

As described above, the controller SG calculates the finish timing of transfer operation to the sheet P, and the second charging section is forced to charge the surface of the second transfer roller with the electric charges having the same polarity as the main polarity of the unwanted toner. As a result, it becomes possible to easily and precisely prevent unwanted toner on the intermediate transfer member positioned beyond the trailing edge of the sheet P (viewing from the proceeding direction of the sheet P) from adhering on the second transfer roller 7A.

Since the transfer bias voltage of the voltage source 753 functions until the transfer operation to the sheet P completes, transferred image will not be damaged.

In FIG. 5, before the sheet P is conveyed to the second transfer section, at the timing of t1, the second transfer roller 7A moves to a pressing position from an evacuation position (a released position) to be ready for the transfer operation, and at the same time, the second charging section is turned on to charge the surface of the second transfer roller.

After the passage of a predetermined time duration, at the time of t2, the electric power supply to the second charging section 700 stops. Just before the time of t4 for starting the transfer operation, at the time of t3, the transfer bias voltage is applied to the backup roller.

Here, the activating operation of the second charging section 700 finishes before the timing of t4 being the time for starting the transfer operation. However, the last charged position on the circumference surface of the second transfer roller 7A have inference on the toner adhered at the position where the transfer operation starts on the intermediate transfer member 6.

The second charging section 700 is turned on at the timing of t5 just before the timing t6 being the timing of the transfer operation completion and to turn off at the timing of t8 to attain the cleaning function, which has been described by using FIG. 4.

The transfer bias voltage to the backup roller 7B is switched to plus bias voltage for cleaning operation at timing t7 after the timing of the transfer operation completion to the first sheet P.

After that, the transfer bias voltage switched by a power source switching section 757 is supplied to the backup roller 7B at the timing of t9. After that, starting the transfer operation (t10), turning on the second charging section 700 (t11), supplying the bias voltage from the power source 755 to the backup roller are conducted. Then the second transfer roller 7A returns to the evacuation position at the timing of t14 when the second transfer process completes.

When the size of the feeding edge in the corresponding direction of the sheet to be used (in this embodiment, it is a side in the longitudinal direction) is smaller comparing with the area to be developed by the developing section 4, there is a possibility that unwanted toner adheres on the area of the photosensitive member 1 and the intermediate transfer member 6, which is outside the side being parallel to the direction of conveyance direction of the sheet P (meaning an area outside the toner image area).

This unwanted toner adheres on the second transfer roller 7A while the toner image on the intermediate transfer member 6 is transferred onto the sheet P. However, this unwanted toner is returned to the intermediate transfer member while the second charging section 700, which functions as a cleaning section, is activated and the surface of the intermediate transfer roller is kept clean.

There is a case that the polarity of the unwanted toner described above is unidentified. In order to enhance the cleaning capability to this type of toner, it is preferable that not only charging by direct current (DC) bias voltage of the second charging section 700 but also charging by AC (Alternate Current) bias voltage is superimposed onto the surface of the second transfer roller 7A.

For example, when the second charging section 700 is a wire electrode type section, the electrode can be an electrode called Scorotron.

Further, the second charging section described above is not limited to the wire electrode type. It may be a needle type electrode. It may also have a structure, in which the electrode is structured by conductive member having, for example, a plate shape, to which a predetermined voltage is applied, and the conductive member is contacted with the surface of the second transfer roller.

Still, the charging section including the AC bias voltage may be integrated into one unit together with a charging section including direct current bias voltage or may be a separate unit.

According to the present invention, rear surface dirt occurred in a transfer section is appropriately prevented and a stable transfer can be performed by applying a stable transfer bias. As a result, an image forming apparatus capable of stably forming a high quality image can be realized.

What is claimed is:

1. An image forming apparatus comprising:

a first transfer section for transferring a toner image, which is formed on an image carrier by utilizing a charging section, an exposing section and a developing section, onto an intermediate transfer member having a belt shape; and a second transfer section for transferring the toner image transferred on the intermediate transfer member onto a recording material by applying an electric field between a second transfer roller being provided outside the intermediate transfer member and a backup roller being provided inside the intermediate transfer member, the second transfer roller and the backup roller sandwiching an intermediate recording member and the recording material;

wherein a bias voltage having a same polarity as a polarity of toner forming the toner image to be transferred is applied to the backup roller through a metal shaft of the backup roller when transfer operation is conducted by the second transfer section, and bias voltage having an opposite polarity to the polarity of toner is applied to the backup roller through the metal shaft of the backup roller when transfer operation is not conducted by the second transfer section;

wherein a metal shaft of the second transfer roller is constantly grounded and further provided is a second charging section for charging a surface of the second transfer roller;

wherein the second charging section charges the surface of the second transfer roller with a same polarity as a polarity of toner forming the toner image to be transferred when a transfer operation by the second transfer section is not conducted;

wherein the second charging section comprises s corona discharging electrode.

2. The image forming apparatus of claim 1, wherein the second charging section is enable to apply a bias voltage, on which AC voltage is superimposed, to the surface of the second transfer roller.

3. The image forming apparatus of claim 1, wherein the second transfer roller presses the backup roller.

* * * * *